US005195749A

United States Patent [19]

Ugarte

[11] Patent Number: 5,195,749

[45] Date of Patent: Mar. 23, 1993

[54] GOLF CLUB HEADS

[75] Inventor: Felipe A. Ugarte, Las Arenas, Spain

[73] Assignee: Makser, S.A., Las Arenas Getxo—(Bizkaia), Spain

[21] Appl. No.: 561,204

[22] Filed: Jul. 30, 1990

Related U.S. Application Data

[63] Continuation of Ser. No. 343,738, Apr. 27, 1989, abandoned.

[30] Foreign Application Priority Data

Apr. 29, 1988 [ES] Spain ..... 8801344

[51] Int. Cl.[5] ..... A63B 69/36; A63B 53/04

[52] U.S. Cl. ..... 273/187.4; 273/163 R; 273/167 B

[58] Field of Search ..... 273/183 D, 183 E, 183 A, 273/167 B, 167 G, 167 J, 78, 163 R, 163 A, 164, 192, 186 A, 194 R, 194 A, 167 R, 77 R; D21/217-219

[56] References Cited

U.S. PATENT DOCUMENTS

| | | | |
|---|---|---|---|
| D. 239,637 | 4/1976 | Loggins | 273/164 X |
| 2,503,506 | 4/1950 | Miller | 273/183 D |
| 2,563,276 | 8/1951 | Riley | 273/167 R |
| 3,033,574 | 5/1962 | Partridge | 273/183 D |
| 3,170,698 | 2/1965 | Schoeffler et al. | 273/183 D |
| 3,198,525 | 8/1965 | Smith | 273/163 R |
| 3,328,032 | 6/1967 | Griswold | 273/163 R |
| 3,360,268 | 12/1967 | Molinari | 273/186 A |
| 3,421,765 | 1/1969 | Scott | 273/183 D |
| 3,507,500 | 4/1970 | Scott | 273/186 D |
| 3,810,633 | 5/1974 | Scott, III | 273/183 D |
| 4,291,883 | 9/1981 | Smart et al. | 273/183 D X |
| 4,601,472 | 7/1986 | Flanagan | 273/186 A |
| 4,720,110 | 1/1988 | Hurst | 273/183 D |
| 4,795,158 | 1/1989 | Kuykendall | 273/164 |

FOREIGN PATENT DOCUMENTS

| | | | |
|---|---|---|---|
| 27807 | of 1912 | United Kingdom | 273/167 B |
| 313699 | 6/1929 | United Kingdom | 273/164 |

*Primary Examiner*—William H. Grieb
*Assistant Examiner*—Sebastiano Passaniti
*Attorney, Agent, or Firm*—Browdy and Neimark

[57] ABSTRACT

A golf club (1), with a head or putter for the specific function of putting, which includes a front face with a negative inclination; a middle section (3) inclined approximately 45°, a section which acts as a mirror with a view to lining up the stroke; an inclined edge (22) which comes from the top end of the inclined face, of the base or of a horizontal surface continuing from the inclined one, with the peculiarity of altering the angle of the said inclination.

7 Claims, 4 Drawing Sheets

GOLF CLUB HEADS

This application is a continuation of application Ser. No. 07/343,738 filed Apr. 27, 1989, now abandoned.

The invention refers to the heads of golf clubs and more specifically to those called Putters, which usually contain a series of defects for the game itself. These defects can be summed up as follows:

The face which is used to strike the ball is usually at a positive angle of a few degrees, understanding that the said face is inclined slightly backwards in relation to a front vertical plane. If a sharp stroke is played, that is that the club is stopped on the moment of impact, an effect called slicing of the ball is produced, with which the ball is given a certain spin, which is not advisable if wishing to send it in a particular direction.

To aim the club, that is to obtain the required alignment in relation to the hole, the position or stance of the player is decisive, given that on a great many occasions this alignment is defective.

Raising the club, that is the so-called Back Swing, which gives the degree of flat or upper in traditional putters, carries with in the danger of raising the club wide, which causes slicing of the ball, thus producing the fact that the ball veers to the right, as mentioned earlier.

Usually, both when putting and when driving, the stroke is played on the ball when the club is rising and once that it has passed the vertical point behind the ball, that is when the head of the club is rising, so that a rotation effect, known as spin, is given to the ball as the putter strikes it above its middle plane.

Undoubtedly, with a negative angle on the striking face of the head on the ball, the putter stroke can be improved, as can the alignment of the ball by the effect of this contact, with U.S. Pat. Nos. 1,467,114 DOERR, 3,085,804 PIEPER and 4,664,385 MACERA in this sense being known.

However, it must be pointed out that these known putters do not manage to overcome the irregularities of the green or, in the same way, do not prevent the ball from fading due to the said irregularities in the green.

The basic objects of the present invention are: in the first place, to prevent the ball from being sliced, either by playing a sharp stroke on hitting the ball or by raising the club wide and making a back swing that moves from outwards in, as well as to align the stroke better and offer fewer possibilities of the ball fading because of irregularities on the green.

A second object of the invention is to obtain a suitable line in order to aim the club with complete independence of the position and stance of the player.

To achieve the first of these objectives, the patent claims the positioning of a front face of the putter, with a specific negative angle, based on an upper end or edge of the said face which is further forward than the lower edge, which makes the ball roll better, without being sliced and with less fade. This angle is between 7 and 15 degrees with respect to the vertical.

This negative angle of the front face can be exactly as described, or with the variant of forming a front face which is vertical or with a positive angle, with a projecting top edge with regard to the superficiality of the said face, so that this edge is the one that makes impact with the ball.

To achieve the said first objective, based on the other variant, the patent claims the positioning of a cut area which starts its inclination from the starting point of the shaft towards the other end of the same, at which this inclination forms an angle with the theoretical longitudinal axis of the body of the putter.

Both innovations can be performed, either together or independently, in a specific putter, which it is wished to put on record for the appropriate purposes, as will be explained more fully later.

To achieve the second of the objectives of the patent, a second face is claimed, which comes from the base of the putter from which the shaft starts, which shows an inclination with respect to the vertical, in that this inclination is positive with respect to the front part of the putter, and with a value of between 40 and 50 degrees, preferably 45 degrees.

This second face is metallic, made of stainless steel, aluminium, etc., and is polished to give a mirror effect, so that it allows the player's sight to be reflected from the upper vertical position towards the front face of the putter.

Combined with this inclined face, with its mirror effect, the top edge of the front face can be equipped with marks, for example a small rise or a notch, so that the direction of the player's sight can be focused towards the ball and the hole with total independence of the said player's stance.

The inclined face mentioned can optionally have a built-in, essentially horizontal lug starting from its top edge, in which the outer edge of this lug is inclined in relation to the longitudinal direction of the putter in order to raise it on the inside, the same as was stated earlier.

The inclined edge can form part of a fin which is independent of the lug but connected to it in a way capable of being turned, with the aim that this fin can occupy different positions to thus vary the angle of its outer edge in relation to the lug and consequently to the whole of the putter. Obviously, the turning point for the fin will be situated on the side of the area where the shaft starts (the shank area), that is on the same side as the golfer, so that the fin can be positioned with the angle desired.

The inclined face with the mirror effect can contain the mirror effect totally or partially, so that the suitably polished area for this purpose does not occupy the whole of the face. In the same way, there can be more than one of these areas, for example two, arranged on both sides of the central area.

Given the complexity of the game of golf itself and of the special characteristics of individual players, the possibilities of carrying out the invention to materialize a putter are varied, and to this effect, and without its having any exclusive nature, we could mention the following:

A. A putter equipped, in accordance with the invention, with a striking face which is positive.

B. A putter, in accordance with the invention, with a striking face which is vertical and is equipped on its top edge with a projection that strikes the ball.

C. A putter, in accordance with the invention, with a positive striking face and a prolongation or base of the said face, from which the shaft rises, which is equipped with an inclined rear edge.

D. A putter, in accordance with the invention, with a normal, negative striking face and a prolongation or base, which is equipped with an inclined rear edge.

E. A putter, in accordance with the invention, with a vertical striking face with a projecting upper edge and a prolongation or base equipped with an inclined rear edge.

F. A putter, in accordance with the invention, with an inclined face with a mirror effect, preferably metallic.

G. A putter, in accordance with the invention, with an inclined face with a mirror effect, preferably metallic, which is equipped with a projecting lug at its top end, with the rear edge of the lug being inclined.

H. A putter, in accordance with the invention, with an inclined face with a mirror effect, preferably metallic, which is equipped with a lug that projects from its top end, with the end of this lug receiving a fin that is retractable with regard to the lug in order to vary the inclination of the rear end or edge of the fin.

I. A putter, in accordance with the invention, with each one of the variants F, G, H and I, in that the top end of the front face is provided with projections or notches for alignment.

J. A putter, in accordance with the invention, with an inclined face without the mirror effect and with an inclined lug or with a retractable fin and lug.

K. A putter, in accordance with the invention, with the combination of variants A and C.

L. A putter, in accordance with the invention, with the combination of the variants mentioned.

Obviously, and as can be deduced from what has been described so far, the possible combinations of the invention are innumerable, and in fact they are all automatically taken in by the present specification, whether contained alone or jointly; the negative face, the inclined face with or without the mirror effect, the rear edge or surface to help improve the back swing, the lug, the fin, etc.

In this respect, and without it having any restrictive nature, a series of drawings is attached, which show the invention in some of its different versions.

FIGS. 15 to 18 refer to another putter solution in accordance with the invention, with a rear inclined face and a negative striking face.

Figure 19:
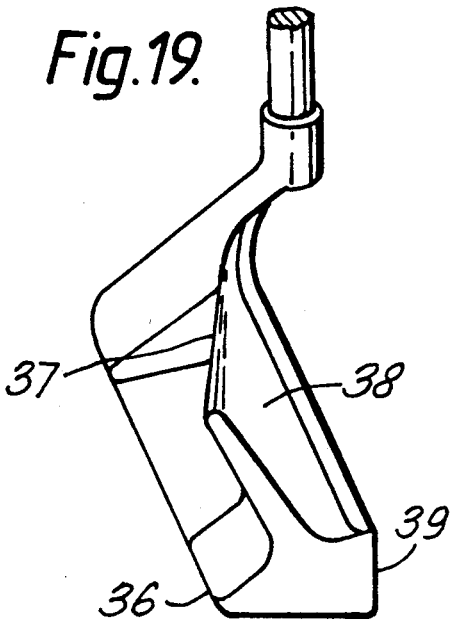

FIG. 19 shows a perspective of a putter in accordance with the invention, which includes a front striking face, a mirror face and an inclined rear line.

Figure 1:
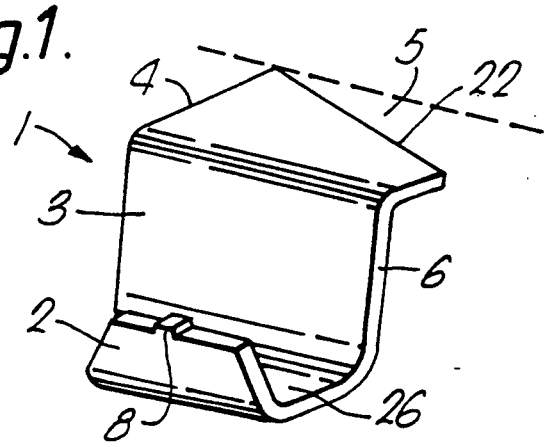
FIG. 1 shows a part provided with a negative face, an inclined face with a mirror effect and a lug.

In FIG. 1, which represents the perspective of a putter (1), it is shown equipped with a striking face (2) which is positive, an inclined face (6) with a mirror effect on its surface (3), a lug (4) projecting from the edge of the face (6), which is provided with an inclined edge (22) at an angle (5). In this figure, the area where the shaft starts, although not shown, is indicated by the position (26).

Figure 2:
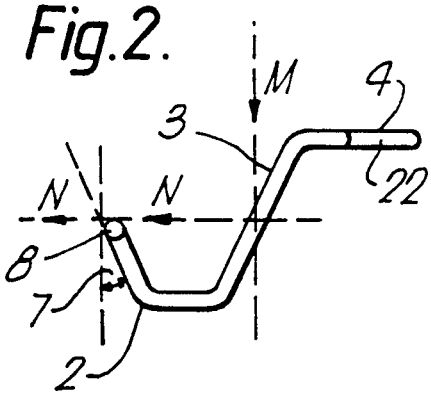
FIG. 2 is a view from the right of the above.

In FIG. 2, we can see the view from the right of the above, drawing attention to the direction indicated by (M)-(N), along which the golfer can direct his sight so that it coincides with the top projection (8) on the front face (2) and towards the hole as a reference. The angle (7) formed by the positive front face can also be seen.

Figure 3:
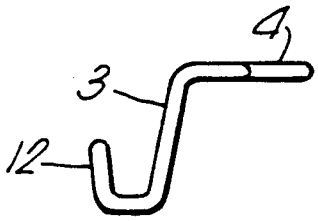
FIG. 3 represents a side view of a putter provided with an inclined face and a lug.
Figure 4:
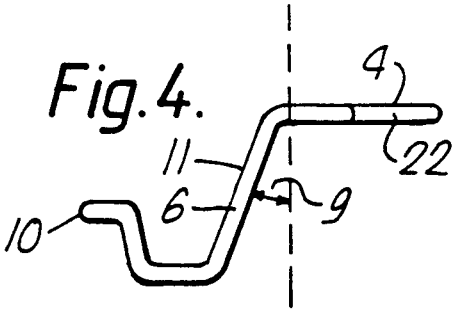
FIG. 4 is a putter with a front face with a projecting section and an inclined face with a lug.

FIG. 3 represents a putter, in accordance with the invention, with a vertical front face (12), a mirror effect inclined face (3) and the lug (4), and, within this same line, we can see, in FIG. 4, the projection (10) on the front face, the inclined face (11) without the mirror effect and the lug (4) with its inclined edge (22). This figure illustrates with (9) the angle formed by the inclined face (6) with respect to the vertical, with this angle being approximately 45°, as stated earlier.

Figure 5:
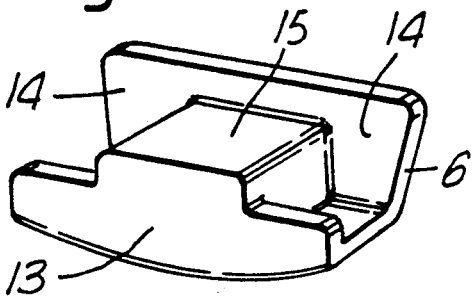
FIG. 5 is a variant with the inclined face and two separate mirror effect areas.

A variant in FIG. 5 shows a putter with a front face (13) of any kind connected to an inclined face (6) by means of a central body (15), so that it provides two mirror effect areas (14) on both sides of the central section (15).

Figure 6:
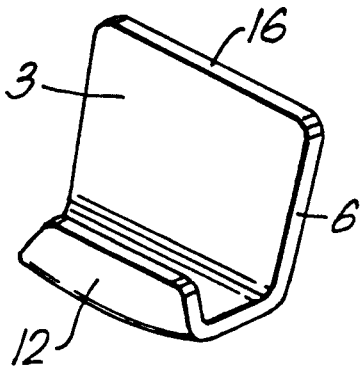
FIG. 6 is a putter with a normal, negative face and an inclined face with a mirror effect.
Figure 7:
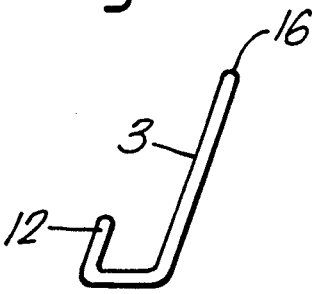
FIG. 7 is a view from the right of the above.

Another variant, as shown in FIGS. 6 and 7, incorporates only the inclined face (6) with the mirror effect (3), any kind of front face (12), for example negative, and a straight top edge (16).

Figure 8:
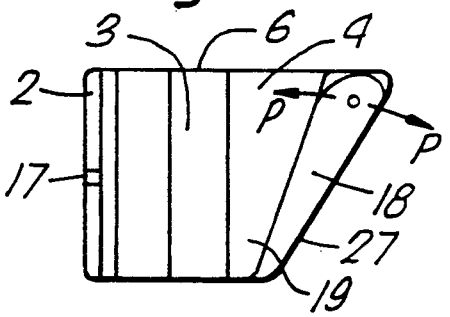
FIG. 8 is a top view of a putter, equipped with a front notch or projection, positive face, inclined face with mirror effect, lug and fin.

As regards FIG. 8, we point out that it illustrates a putter, which has a positive face (2), a notch (17) for alignment and an inclined mirror effect area (3). From this area rises the lug (4) and on its free section is situated the fin (18) provided with an outer edge (27). The fin (18) turns on (19) of the lug (4) according to (P) towards one side or the other, so that the inclination of its edge (27) can be altered.

Figure 9:
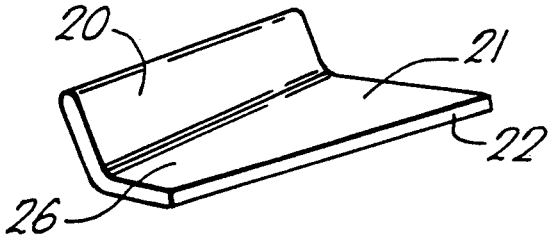
FIG. 9 is a perspective of a putter, with a positive face and inclined rear edge of its base.

The putter shown in FIG. 9 is equipped with front face (20) which is positive and a base (21) from which the shaft rises at (26), with the base (21) having an inclination (22).

Figure 10:
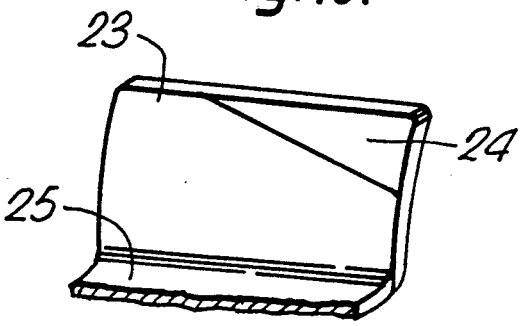
FIG. 10 is a partial perspective of a putter with a partial mirror effect area.
Figure 11:
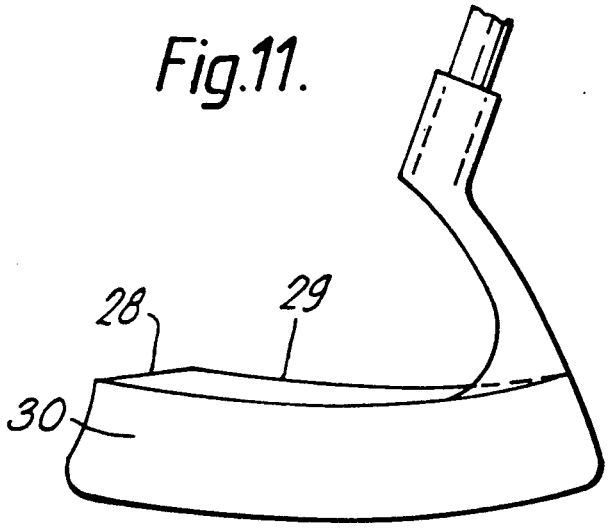
FIGS. 11 to 14 show four views of the putter covered by the invention, with an inclined rear face and positive striking face.
Figure 13:
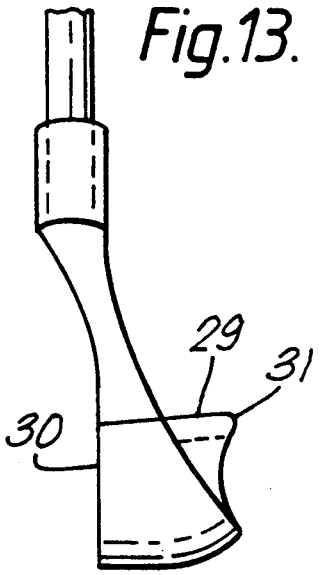
Figure 14:
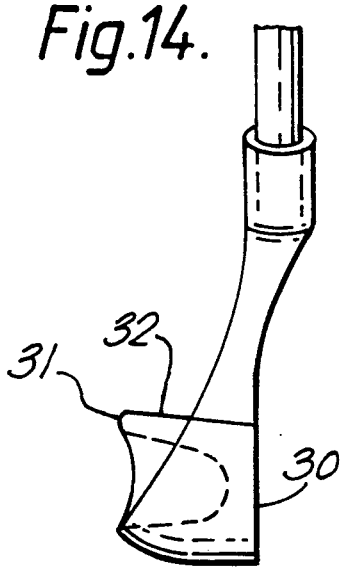
Figure 12:
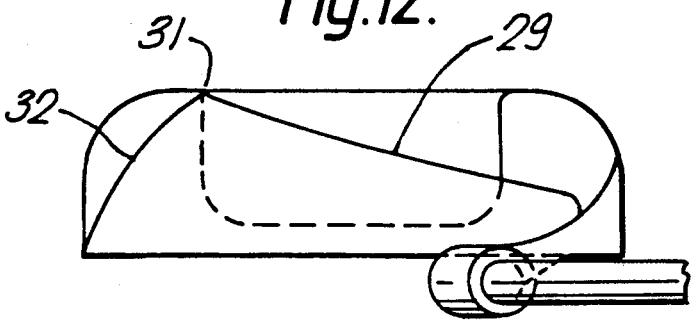
Figure 15:
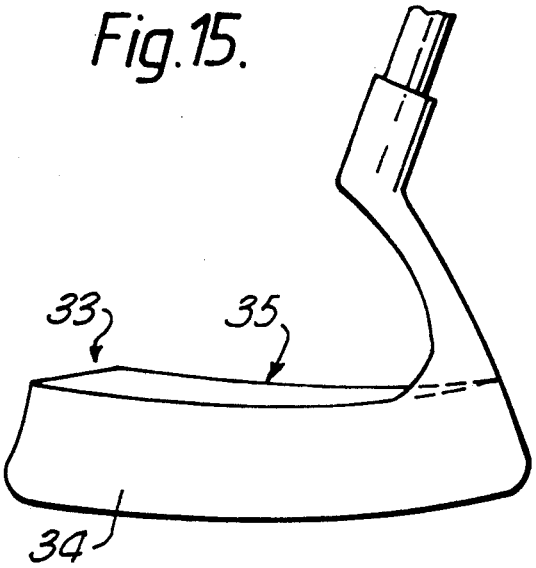

The putter shown in FIG. 10 has a base (25), not shown whole, with an inclined face (23), which has the mirror effect in one portion (24).

In accordance with FIGS. 11 to 14, a putter (28) is described which is equipped with a positive striking face (30) and an inclined rear face (29), which is established from where the shaft rises to an end point (31). from where a rounded area (32) is produced until it joins the striking face (30).

Figure 17:
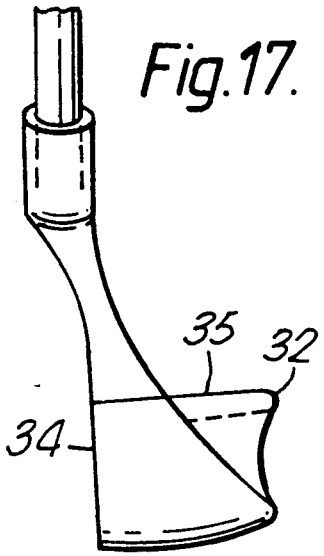
Figure 16:
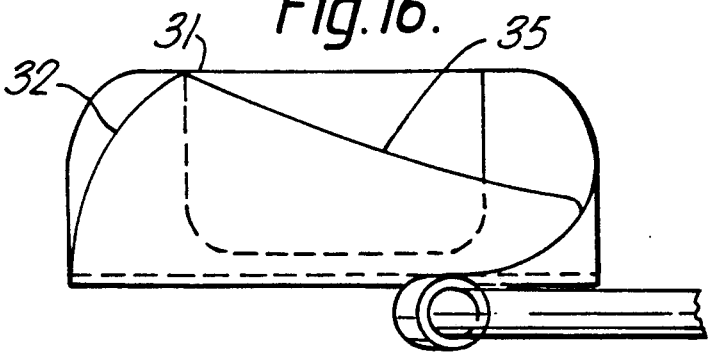
Figure 18:
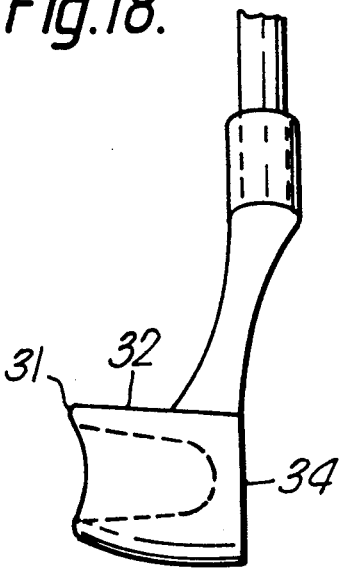

The putter shown in FIGS. 15 to 18 is an item (33) with a striking face (34) which is at a negative angle, as can be specifically seen in the side views in FIGS. 17 and 18. This putter (33) is also provided with the inclined rear section (35) up to the point (31) and from the rounded area (32) to the face (34).

The putter (36) in FIG. 19 is provided with a striking face (39) with a positive or negative angle. a face (38) which acts as a mirror and an inclined wall (37).

On the other hand, as is already known, the putter of the invention can be provided with a hollow slot or gap behind its striking face, so that it forms a wall of variable thickness and front surface, which increases the stroke contact on the ball.

It is important to emphasize, once having described the nature and advantages of this invention, its nonrestrictive character, inasmuch as changes in the shape, material or dimensions of its constituent parts will not in any way alter its essence, as long as they do not mean a substantial variation of the whole.

I claim:

1. An improved golf club head for a putter comprising front face means having a negative inclination, means to obtain alignment of a shank of the club with a ball and a hole independently of a golfer's stance, and means to prevent said shank from moving outward combined on one single club;

wherein said means to align the ball and hole consists of an intermediate face (3) which is at least partially smooth and polished and mirror shiny, is recessed with respect to said front face means and wherein said intermediate face has a 40 to 50 degree incline with respect to a vertical plane and is combined with a groove (17) or ridge (8) placed in an upper edge of said front face means of said club head.

2. The golf club head of claim 1, wherein the intermediate face is made of a stainless steel material.

3. The golf head of claim 1, wherein the intermediate face is made of aluminum material.

4. The golf club head of claim 1, wherein the means to prevent the shank from moving outward consists of an inclined edge (22) made in a body of the shank, and an extension thereof behind the front face, wherein said inclined edge is variable and opens from a position of the golfer forming an angle with a longitudinal axis in a heel-toe direction.

5. The golf club head of claim 4, wherein the inclined edge is at a base of the head where the shank starts.

6. An improved golf club head for a putter comprising front face means having a negative inclination, means to obtain alignment of a shank of the club with a ball and a hole independently of a golfer's stance, and means to prevent said shank from moving outward combined on one single club;

wherein said means to align the ball and hole consists of an intermediate face (3) recessed with respect to a front face which is at least partially smooth and polished and mirror shiny, and wherein said intermediate face has a 40°-50° incline with respect to a vertical plane and is combined with a groove (17) or ridge (8) placed in an upper edge of said front face of said club head;

wherein the means to prevent the shank from moving outward consists of an inclined edge (22) made in a body of the shank and an extension thereof behind the front face, wherein said inclined edge is variable and opens from a position of the golfer forming an angle with a longitudinal axis in a heel-toe direction; and wherein an upper end of an intermediate face forms a horizontal lug (4) with the inclined edge (22) inclined in relation to a horizontal plane of the head.

7. The golf club heads of claim 6, wherein an edge of the lug accommodates a blade (18), which has a turning point in said lug in a plane parallel to that of the blade to vary the inclination of an edge of the blade with respect to the longitudinal direction of the head.

* * * * *